US005370595A

United States Patent [19]

Voris et al.

[11] Patent Number: 5,370,595

[45] Date of Patent: Dec. 6, 1994

[54] EXERCISING APPARATUS WITH ADJUSTABLE WORKOUT BENCH

[75] Inventors: Harvey C. Voris, Huntington Beach; Barry H. Brooks, Pomona, both of Calif.

[73] Assignee: Paramount Fitness Equipment Corp., Los Angeles, Calif.

[21] Appl. No.: 119,801

[22] Filed: Sep. 13, 1993

Related U.S. Application Data

[63] Continuation of Ser. No. 872,552, Apr. 23, 1992, abandoned.

[51] Int. Cl.[5] ..... A63B 21/062

[52] U.S. Cl. ..... 482/100; 482/142; 482/908

[58] Field of Search ..... 482/94, 97–103, 482/133–138, 142, 908; 297/19, 21, 363

[56] References Cited

U.S. PATENT DOCUMENTS

| | | | |
|---|---|---|---|
| 3,905,599 | 9/1975 | Mazman | 482/98 |
| 3,912,263 | 10/1975 | Yatso | 482/98 |
| 4,098,502 | 7/1978 | Faust . | |
| 4,286,782 | 9/1981 | Fuhrhop | 482/103 X |
| 4,339,125 | 7/1982 | Uyeda et al. | 482/98 |
| 4,353,547 | 10/1982 | Jenkinson . | |
| 4,358,108 | 11/1982 | Voris | 482/98 |
| 4,358,109 | 11/1982 | Schrems | 482/142 |
| 4,511,137 | 4/1985 | Jones . | |
| 4,546,967 | 10/1985 | Kecala . | |
| 4,546,970 | 10/1985 | Mahnke | 482/98 |
| 4,549,733 | 10/1985 | Salyer . | |
| 4,603,855 | 8/1986 | Sebelle | 482/103 |
| 4,635,934 | 1/1987 | Boethke . | |
| 4,641,837 | 2/1987 | Ruth . | |
| 4,653,751 | 3/1987 | Green . | |
| 4,746,114 | 5/1988 | Grider . | |
| 4,765,616 | 8/1988 | Wolff . | |
| 4,793,608 | 12/1988 | Mahnke et al. | 482/138 X |
| 4,817,943 | 4/1989 | Pipasik . | |
| 4,826,157 | 5/1989 | Fitzpatrick | 482/103 X |
| 4,828,255 | 5/1989 | Lahman | 482/908 X |
| 4,898,381 | 2/1990 | Gordon . | |
| 4,919,419 | 4/1990 | Houston | 482/138 |
| 5,058,888 | 10/1991 | Walker et al. | 482/142 X |
| 5,060,939 | 10/1991 | Oswald et al. | 482/137 X |
| 5,082,259 | 1/1992 | Gonzalez | 482/142 X |

*Primary Examiner*—Richard J. Apley
*Assistant Examiner*—John Mulcahy
*Attorney, Agent, or Firm*—Robbins, Berliner & Carson

[57] ABSTRACT

An exercise apparatus with a horizontally adjustable, detachable, and inclinable workout bench that is combinable with an angularly adjustable bench press. The apparatus includes a main frame and a foundation member extending horizontally from the main frame, which supports the bench. The bench is removably coupled to the foundation member by a base for horizontal displacement and detachment of the bench from the main frame. The bench includes a body support that is pivotally connected to the distal end of the base and pivotally connected to the base at a second point through a raising and lowering arm. The seat portion of the bench may be positioned perpendicular to the back portion. A brace is nested in a container located beneath the back portion and a seat support is located beneath the seat portion. When the user desires to position the back portion and the seat portion perpendicular to each other, the seat portion is rotated about a hinge and the brace is positioned partially out of the container so that the top of the brace abuts the side edge of the seat support. Further, the workout bench of the present invention is combined with an angularly adjustable bench press.

5 Claims, 3 Drawing Sheets

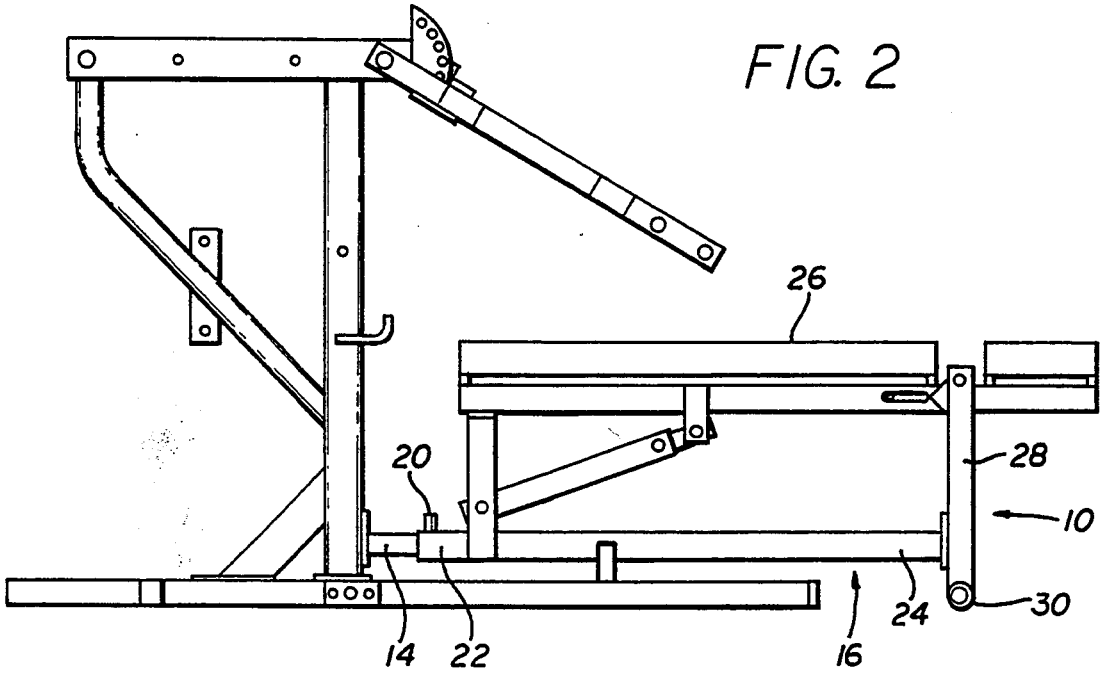
FIG. 2
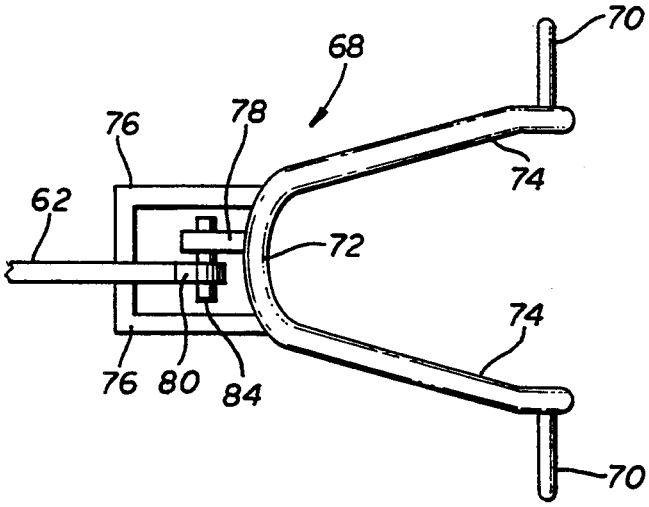
FIG. 5
FIG. 6
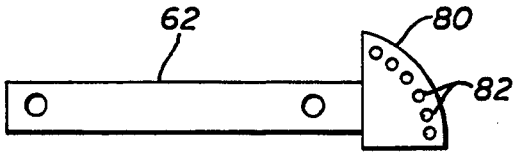

EXERCISING APPARATUS WITH ADJUSTABLE WORKOUT BENCH

This application is a continuation of U.S. patent application Ser. No. 07/872,552 filed Apr. 23, 1992, now abandoned.

FIELD OF THE INVENTION

The present invention relates to exercise apparatus and, more particularly, to an exercise apparatus that can be adjusted to a wide variety of different positions to accommodate a wide variety of users.

BACKGROUND OF THE INVENTION

Correct positioning of an exercise bench relative to an exercise unit has long been recognized as an important element of proper weightlifting. Some prior art patents, such as U.S. Pat. No. 4,793,608, issued to Mahnke et al., disclose a workout bench connected to a main frame for support. The Mahnke et al. bench is positioned high enough off the ground to permit the user to do leg extension work. However, this positioning results in the user's feet being off the ground when the bench is completely horizontal. Therefore, the user's feet cannot provide stability for the user when the user preforms exercises in a horizontal position.

The seat portion of the Mahnke et al. bench cannot be inclined. Further, the Mahnke et al. seat, rather than the bench, is horizontally adjustable. Consequently, the seat cannot be adjusted horizontally when the bench is completely horizontal.

U.S. Pat. No. 4,635,934, issued to Roethke, discloses an exercise bench and a tower. The bench is vertically adjustable, and includes a seat that is horizontally adjustable along the length of a central frame member. The Roethke bench is supported at one end by a frame member and at the other end by a single leg so that the seat and frame member are elevated above the ground. Similar to the Mahnke et al. bench, the Roethke seat, rather than the bench, adjusts along the length of the central frame member. Additionally, the incorporation of a seat that is not fixed to the elevating supports results in variable stresses being placed on the supports as the seat is adjusted. This decreases the structural stability of the bench.

U.S. Pat. No. 4,765,616, issued to Wolff, also discloses an elevated, laterally extending frame member that supports a two section bench. The seat, rather than the bench, adjusts along the laterally extending frame member.

SUMMARY OF THE INVENTION

The present invention comprises a horizontally adjustable workout bench rather than a horizontally adjustable seat. The bench is horizontally adjustable and inclinable to a wide range of positions and may even be detached from the main frame, while the seat is horizontally fixed to its base by two pivotal connections. The present invention thus combines a structurally strong bench with horizontal adjustability.

The inclinability of the present invention bench is independent of the horizontal position of the bench. Therefore, the position of the bench may be horizontally adjusted when the bench is fully inclined. The versatility of the horizontal adjustability and the incline adjustability of the bench permits the bench to be positioned in an optimum location for weightlifting for a variety of body sizes.

Additionally, the seat portion of the bench may be positioned perpendicular to the back portion. A brace is nested in a container located beneath the back portion and a seat support is located beneath the seat portion. When the user desires to position the back portion and the seat portion perpendicular to each other, the seat portion is rotated about a hinge and the brace is positioned partially out of the container so that the top of the brace abuts the side edge of the seat support. The versatility of the seat portion allows the user to sit on the seat portion when the back portion is inclined for incline bench work and shoulder press exercises to provide additional back support.

Further, the workout bench of the present invention may be combined with an angularly adjustable bench press. The ability to adjust the horizontal position of the bench, the incline of the bench, the position of the seat portion of the bench, and the angle of the bench press permits the achievement of the ideal positioning of bench and bench press for any body size.

Specifically, the present invention comprises: a main frame; a foundation member extending horizontally from the main frame; a bench, including a base member, removably coupled to the foundation member and horizontally displaceable from the main frame; a body support member pivotally attached to the distal end of the base member; and means, pivotally connected to the base member and pivotally connected to the underside of the body support member, for raising and lowering the proximal end of the body support member.

In an alternative embodiment, the exercising apparatus of the present invention has a bench press including a lifting arm pivotally connected to the main frame, and a lifting handle pivotally attached to the lifting arm. The lifting handle is angularly adjustable to a plurality of angles whereby the height and angle of the lifting handle can be adjusted relative to the bench.

BRIEF DESCRIPTION OF THE DRAWINGS

The above and other features of the present invention may be more fully understood from the following detailed description, taken together with the accompanying drawings, wherein similar characters refer to similar elements throughout and in which:

FIG. 2 is a side elevational view of the exercising apparatus of FIG. 1 showing the bench with the back portion and the seat portion in horizontal positions;

FIG. 5 is a plan view of the lifting arm of one form of the present invention as shown in FIG. 1; and FIG. 6 is an elevational view of the angularly adjustable lifting handle and the lifting arm of the exercising apparatus of FIG. 1.

DESCRIPTION OF THE PREFERRED EMBODIMENTS

Figure 1:
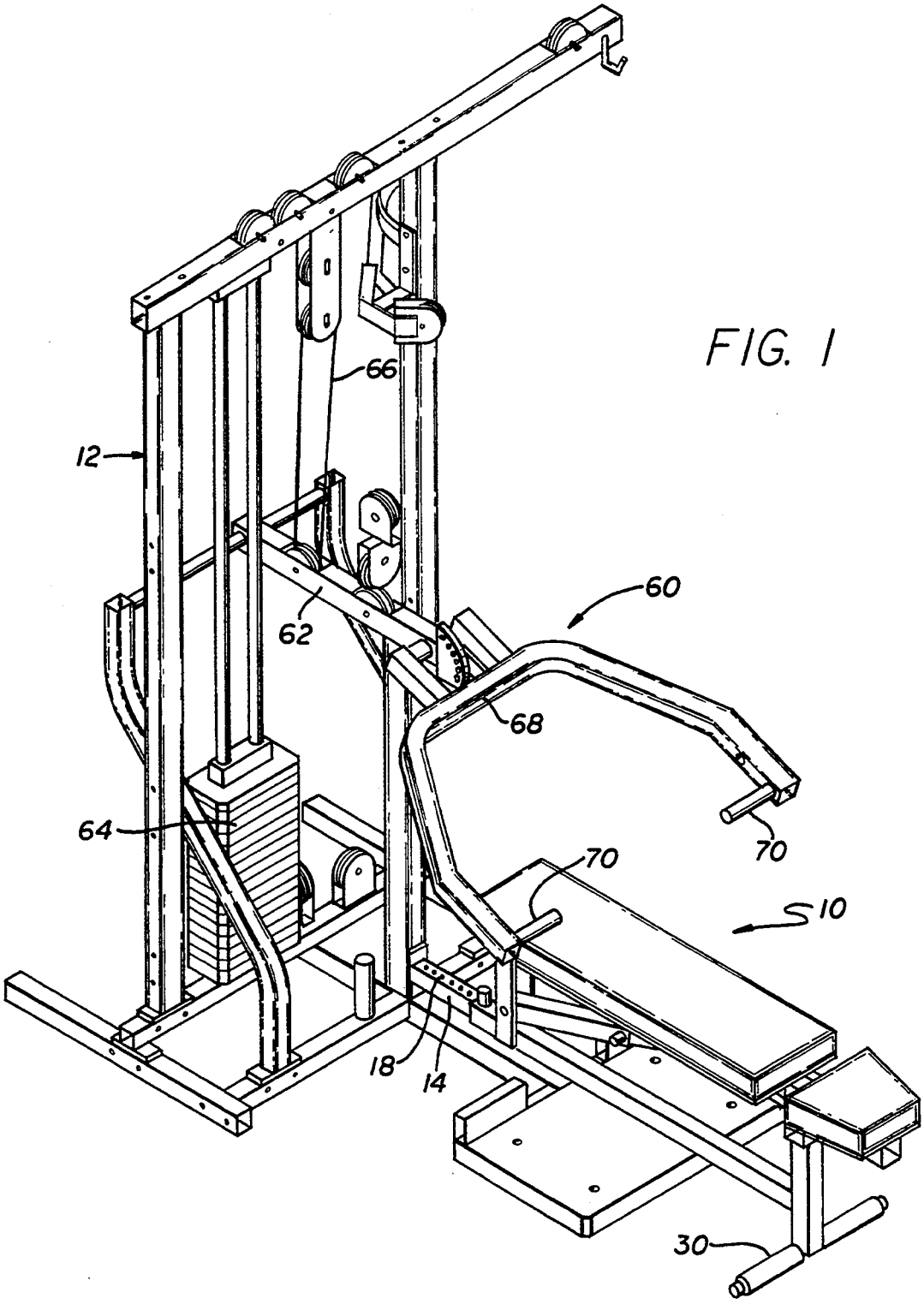
FIG. 1 is a perspective view of the exercising apparatus constructed according to a preferred embodiment of the present invention.

Referring to FIG. 1, in a preferred form of an exercising apparatus constructed according to the present invention, a bench 10 is removably coupled to a main frame 12 through a foundation member 14 that extends horizontally from the main frame 12. The foundation member 14 is a metal tube secured to and projecting from the base of the main frame 12. The foundation member 14 and the main frame 12 stabilize the bench 10 to prevent the bench 10 from shifting or sliding during exercise.

As shown in FIG. 2, the bench 10 includes a base member 16 that is removably coupled to the foundation member 14. The foundation member 14 is a rectangular metal tube with a series of first lock holes 18 (FIG. 1) located along its top. The base 16 is a second rectangular tube with a larger cross section that is complemental to the cross section of the foundation member 14 so that the base 16 is slidably mounted over the foundation member 14. The base 16 has a positioning hole (not shown) at its end adjacent the main frame 12 and it is provided with a lock pin 20 that extends through the positioning hole. The lock pin 20 is spring biased to extend through the positioning hole and to seat in one of the first lock holes 18 in the foundation member 14. The lock pin 20 is enlarged at its top so that a user may pull the lock pin 20 upwardly from its locking position. The base 16 and the bench 10 may be moved forwardly or rearwardly along the foundation member 14 to the desired position and the lock pin 20 released to extend into a lock hole 18 to hold the foundation 14 base 16 in position with respect to the foundation member 14.

In the preferred embodiment, the lock pin 20, the lock holes 18 and the positioning hole comprise a means for coupling the foundation member 14 to the base 16 so that the foundation member 14 will stabilize the bench 10. In other embodiments, the coupling means may include a base that is slidably mounted over a track or a roller bed.

The base 16 has a proximal end 22 to the main frame 12 through which the positioning hole extends, and a distal end 24. The bench 10 also includes a body support member 26 that is pivotally attached to the distal end 24 of the base 16. In FIG. 2, the body support 26 is in a horizontal position so that the body support 26 is parallel to the base 16 and the foundation member 14.

In the preferred embodiment, the body support 26 is secured to the base 16 by a leg 28 that is fixedly attached at its lower end to the base 16. The distal end of the body support 26 is pivotally attached to the upper end of the leg 28. The leg 28 extends below the base 16 such that the base 16 and the foundation member 14 are slightly elevated off the ground. To assist in horizontally displacing the bench 10 forwardly or rearwardly from the main frame 12, a rolling member 30 is attached to the distal end of the leg 28. The roller 30 rolls along the ground when the bench is being moved toward or away from the main frame 12.

Figure 3:
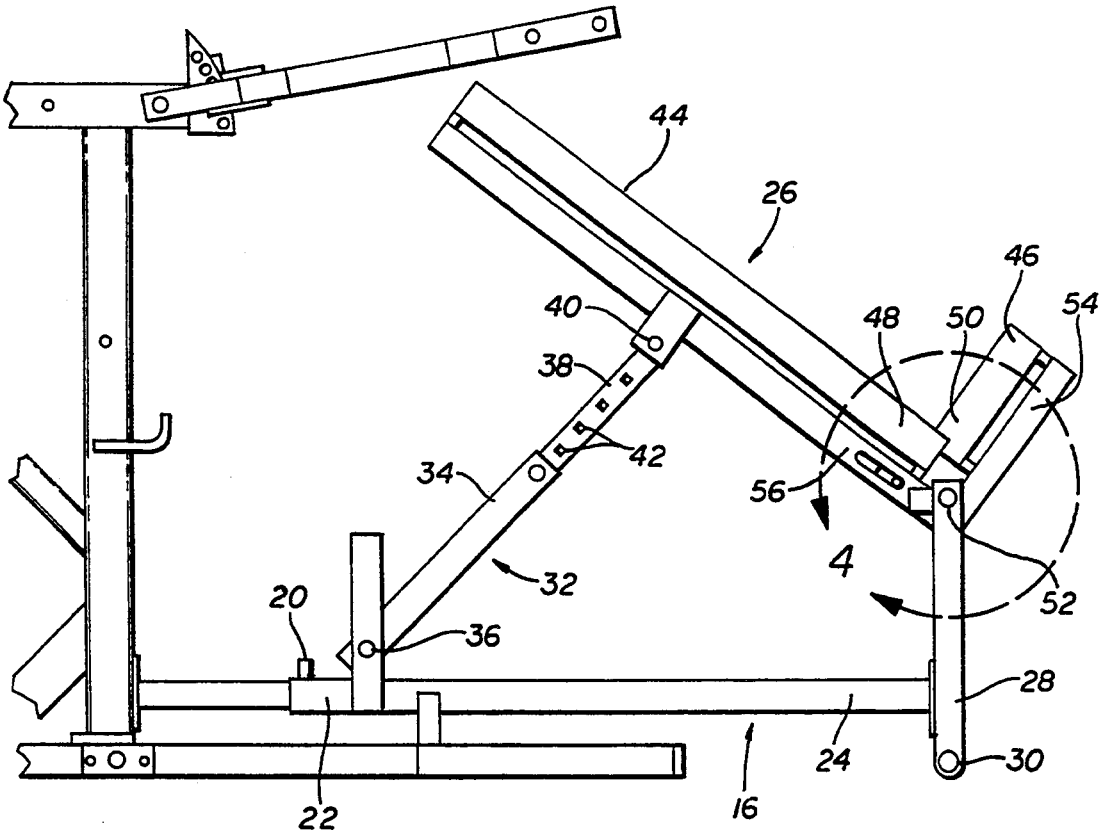
FIG. 3 is a side elevational view of the exercising apparatus of FIG. 1 showing the bench with the back portion inclined and the seat portion positioned perpendicular to the back portion.

As shown in FIGS. 2 and 3, the body support 26 may be inclined by a raising and lowering arm 32 that is pivotally connected to the proximal end 22 of the base 16 and is also pivotally connected to the underside of the body support 26. In the preferred embodiment, the raising and lowering arm 32 includes a first extending member 34 pivotally connected by a first pivot 36 to the proximal end 22 of the base 16. A second extending member 38 is pivotally connected by a second pivot 40 to the underside of the body support 26. The first extension 34 and the second extension 38 cooperate telescopically with each other so that, as shown in FIGS. 2 and 3, the body support 26 may be inclined by extending the second extension 38 out of the first extension 34.

The second extension 38 has a series of second lock holes 42 along its length, while the first extension 34 has a single positioning hole (not shown) at its end adjacent the second extension 38. As described above with regard to the locking means for the foundation member 14 and the base 16, the raising and lowering arm 32 may be locked at a desired position of extension with a lock pin (not shown) that extends through the positioning hole at the top of the first extension 34 and through an aligned locking hole 42 in the second extension 38.

Figure 4:
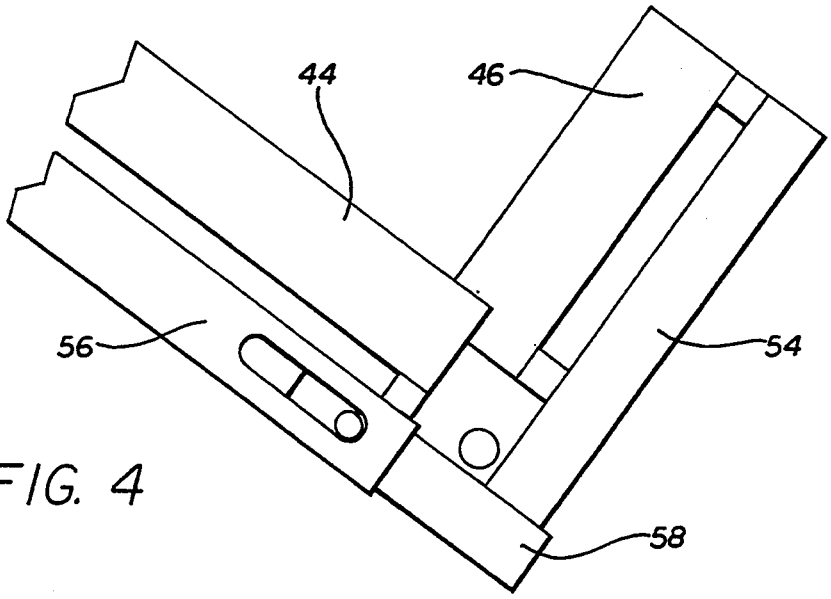
FIG. 4 is an enlarged fragmentary sectional view taken along the line 4—4 of FIG. 3, showing the bracing member.

Referring to FIGS. 3 and 4, the present invention includes an exercise bench with a body support 26 that has a relatively long back portion 44 and a relatively short seat portion 46. The base 16 is pivotally connected at its distal end 24 to the distal end 48 of the back portion 44 and pivotally connected to the proximal end 50 of the seat portion 46 by a third pivot 52. A seat support member 54 is connected to the underside of the seat portion 46.

As shown in FIGS. 2 and 3, the back portion 44 and the seat portion 46 may be positioned such that they are either parallel or perpendicular to one another. To retain the seat portion 46 in a position perpendicular to the back portion 44, the present invention includes a hollow rectangular container member 56 that is connected to the underside of the back portion 44. The present invention also includes a rectangular bracing member 58, as shown in FIG. 4, with a cross section smaller than the cross section of the container 56 such that the brace 58 can be nested inside the container 56 when the seat portion 46 and the back portion 44 are parallel to one another, as shown in FIG. 2.

However, when the user desires to have the seat portion 46 perpendicular to the back portion 44, as when the back portion 44 is inclined as shown in FIG. 3, the user pivots the seat portion 46 about the third pivot 52 until the seat portion 46 is perpendicular with the back portion 44. Next, the user slides the brace 58 out of the container 56 until it is positioned at least partially out of the container 56 and the remote end of the brace 58 is perpendicular to and abutting the end of the seat support 54. In this manner, the remote end of the brace 58 supports the inner end of the seat support 54 and retains the seat portion 46 in a perpendicular position relative to the back portion 44.

Referring again to FIG. 1, the present invention also includes an exercise unit 60, commonly called an incline bench press. The exercise unit 60 includes a lifting arm 62 that extends horizontally outward from the main frame 12 and over the bench 10. The lifting arm 62 is pivotally connected to the main frame 12 to move in a vertical plane and also connected to a weight stack 64 by a transmitting means 66, such as a cable. The exercise unit 60 also includes a lifting handle 68 with spaced-apart hand grips 70 for engagement by the user.

As shown in FIG. 5, the lifting handle 68 is generally U-shaped in a configuration having a center portion 72 and angularly outwardly extending portions 74. The center portion 72 is pivotally connected to the end of the lifting arm 62 by connecting bars 76 that are attached to opposite sides of the lifting arm 62. Also attached to the lifting handle 68 is a locking bar 78 that extends toward the lifting arm 62 from the midpoint of the center portion 72 and parallel to the connecting bars 76.

FIGS. 5 and 6 show the end of the lifting arm 62 that is adjacent the lifting handle 68. A planar pivot plate 80 is secured to the end of the lifting arm 62 between the connecting bars 76. The pivot plate 80 is generally shaped like a quarter circle, with two perpendicular edges and an arced edge connecting the remote ends of the perpendicular edges. The pivot plate 80 is connected to the lifting arm 62 along one of its perpendicular edges so that the arced edge is proximal to the lifting handle 68.

Along the arced edge of the pivot plate 80 is a plurality of spaced holes 82 that permit the lifting handle 68 to be locked in a plurality of positions, as shown in FIGS. 1, 2, 3 and 5, by aligning a hole in the proximal end of the locking bar 78 with one of the spaced holes 82. As the lifting handle 68 is pivoted, the hole in the locking bar 78 aligns with a different hole in the arced edge of the pivot plate 80. At a desired angular position for the lifting handle 68, a second lock pin 84 is inserted through the aligned holes to retain the lifting handle 68 in place. In this manner, the user may position the lifting handle 68 at a plurality of angles and the height and the angle of the lifting handle 68 can be adjusted relative to the bench 10.

Although described for purposes of clarity with respect to specific preferred embodiments, the present invention is not limited to those embodiments but rather is applicable broadly to all versions falling within the scope and spirit of the appended claims.

What is claimed is:

1. An exercise bench, comprising:

a body support member having a relatively long back portion and a relatively short seat portion, said back portion and said seat portion each having a first end and a second end;

a base member having a first end and a second end, said second end being pivotally connected to said second end of said back portion and pivotally connected to said first end of said seat portion;

means pivotally connected to said base member and pivotally connected to the underside of said back portion, for raising and lowering said back portion;

a seat support member connected to said underside of the seat portion and having a first end positioned below said first end of said seat portion;

a container member connected to the underside of said second end of the back portion; and a bracing member having a cross section such that the bracing member can be nested in the container member, the bracing member being positioned partially out of the container member and away from the second end of the back portion when the back portion and the seat portion are inclined perpendicular to each other, such that the bracing member is perpendicular to the seat support member and the bracing member abuts the first end of the seat support member.

2. An exercise apparatus, comprising:

a main frame;

a foundation member extending horizontally from said main frame; and a bench, comprising:

a body support member having a relatively long back portion and a relatively short seat portion, said back portion and said seat portion each having a first end and a second end;

a base member removably coupled to said main frame through a foundation member and horizontally displaceable from said main frame, said base member having a first end and a second end, said second end being pivotally connected to said second end of said back portion and pivotally connected to said first end of said seat portion;

means pivotally connected to said base member and pivotally connected to the underside of said back portion, for raising and lowering said back portion;

a seat support member connected to said underside of said seat portion and having a first end positioned below said first end of said seat portion;

a container member connected to said underside of said second end of said back portion; and a bracing member having a cross section such that said bracing member can be nested in said container member, said bracing member being positioned partially out of said container member and away from said second end of said back portion when said back portion and said seat portion are inclined perpendicular to each other, such that said bracing member is perpendicular to said seat support member and said bracing member abuts said first end of said seat support member.

3. An exercising apparatus, comprising:

a main frame;

a foundation member extending horizontally from said main frame;

a bench, comprising:

a base member removably coupled to said foundation member, horizontally displaceable from said main frame, and having a first end proximal to said main frame and a second end distal from said main frame;

a body support member pivotally attached to said second end of said base member;

means pivotally connected to said base member and pivotally connected to said underside of said body support member, for raising and lowering a proximal end of said body support member;

a leg support extending upwardly from the second end of the base member and pivotally connected to the body support member, the leg support also extending below the base member; and a rolling member attached to a distal end of the leg support.

4. An exercising apparatus, comprising:

a main frame including a weight stack;

a foundation member extending horizontally from said main frame;

a bench, comprising:

a base member coupled to said foundation member and horizontally displaceable from said main frame, and having a first end proximal to said main frame and a second end distal from said main frame;

a body support member pivotally attached to said second end of said base member;

a leg support extending upwardly from said second end of said base member and pivotally connected to said body support member, said leg support also extending below said base member; and a rolling member attached to a distal end of said leg support; and means pivotally connected to said base member and pivotally connected to said underside of said body support member, for raising and lowering the proximal end of said body support member; and an exercise unit, comprising:

a lifting arm extending horizontally outward over said foundation member and connected to said weight stack by transmitting means, said lifting arm having a first end and a second end, said first end being pivotally connected to said main frame, and said second end including a pivot plate with a plurality of spaced holes disposed along an arc; and an angularly adjustable lifting handle pivotally connected to said lifting arm said lifting handle having adjustment means for cooperation with said pivot plate to position said lifting handle at a plurality of angles whereby said height and angle of said lifting handle can be adjusted relative to said bench.

5. An exercising apparatus, comprising:

a main frame;

a foundation member extending horizontally from said main frame;

a bench removably coupled to said foundation member for horizontal displacement of said bench from said main frame, said bench comprising:

a base member having a first end proximal to said main frame and a second end distal from said main frame;

body support means pivotally connected to said base member at a distal end and at a proximal end;

means for raising and lowering said proximal end of said body support means about said distal end; and a support member for adding support to said exercising apparatus when said bench is coupled to said foundation member; wherein said support member extends upwardly from said second end of said base member and is pivotally connected to said body support means, and wherein said support member extends below said base member and comprising a rolling member attached to a distal end of said support member.

* * * * *